United States Patent [19]

Pelletier et al.

[11] 3,973,761

[45] Aug. 10, 1976

[54] FURNACE TAPPING APPARATUS

[75] Inventors: Albert Pelletier; Geoffrey D. Hallett, both of Noranda, Canada

[73] Assignee: Noranda Mines Limited, Ontario, Canada

[22] Filed: May 9, 1974

[21] Appl. No.: 468,524

[30] Foreign Application Priority Data

Sept. 27, 1973 Canada ..... 182037

[52] U.S. Cl. ..... 266/272; 266/187; 266/195

[51] Int. Cl.[2] ..... C21B 7/12; C21B 7/16

[58] Field of Search ..... 266/38, 41, 42

[56] References Cited

UNITED STATES PATENTS

| | | | |
|---|---|---|---|
| 728,727 | 5/1903 | Von Kerpely | 266/38 |
| 1,097,345 | 5/1914 | Meyer | 266/42 |
| 1,841,338 | 1/1932 | Schiegries et al. | 266/42 |
| 2,468,738 | 5/1949 | Durfee et al. | 266/41 X |
| 3,610,183 | 10/1971 | Kolboy et al. | 266/41 X |
| 3,823,931 | 7/1974 | Wells et al. | 266/42 |

FOREIGN PATENTS OR APPLICATIONS

| | | | |
|---|---|---|---|
| 2,432 | 1857 | United Kingdom | 266/35 |

*Primary Examiner*—Gerald A. Dost
*Attorney, Agent, or Firm*—Fleit & Jacobson

[57] ABSTRACT

A method and an apparatus for stopping the flow of metal from the taphole of a furnace. The method comprises the step of blowing air into the taphole with sufficient pressure to reverse the flow of the molten metal, and then reducing the pressure to a value sufficient to hold the metal in the furnace. The apparatus comprises a pipe adapted to be inserted into the taphole and of sufficient dimension to seal the taphole, and means for blowing air into the pipe initially at a predetermined pressure so as to reverse the flow of the molten metal in the taphole and then at a reduced pressure sufficient to hold the metal in the furnace.

8 Claims, 10 Drawing Figures

66
64
104
70
88
86
54
80
78
74
82
8
8
58
56
92
68
102

76
74
56
54
70
78
82
90
88
104
68
58
80
92
86
60

FURNACE TAPPING APPARATUS

This invention relates to a method of stopping the flow of molten metal from the taphole of a furnace and to an appartus for carrying out the method.

BACKGROUND OF THE INVENTION

It is commonly known to use a so-called clay gun to close the taphole of a furnace and an oxygen lance to open it. In the use of a clay gun to plug the taphole of a furnace, clay is introduced under pressure into the taphole at the end of the casting period and such clay hardens to form a plug which stops the flow of molten metal. The clay plug is removed by drilling or by means of an oxygen lance when casting is resumed. More recently, it has been proposed to heat the taphole by means of a small furnace placed around the taphole so as to melt the metal in the taphole and permit it to flow, and to stop heating to block the flow of molten metal at the end of the casting period. The opening of tapholes by drilling or by means of an oxygen lance as in the first above-mentioned method is time consuming while, with the second above-mentioned method, stopping the flow of molten metal by cooling is unreliable.

SUMMARY OF THE INVENTION

It is therefore the object of the present invention to provide a new method of tapping a furnace and a new apparatus for carrying out the method.

The method, in accordance with the invention, for stopping the flow of metal from the taphole of a furnace comprises the steps of blowing air into the taphole with a sufficient pressure to reverse the flow of molten metal, and then reducing the pressure to a value sufficient to hold the metal in the furnace.

The pressure required to stop the flow of metal in the taphole and to subsequently hold the metal in the furnace will vary with the density of the metal and with the height of the material in the furnace. It has been found that, with a level of 53 inches of molten copper, matte and slag in the furnace, a pressure of 60–70 psi was needed to stop the flow. Once the flow was reversed, an air pressure of 20–30 psi was sufficient to hold the metal in the furnace.

The air pipe used to plug the taphole has to be pushed into the taphole quickly to avoid splashing.

The metal can be made to freeze in the hole by lowering the air pressure slowly, or it can be made to flow again by removing the pipe quickly.

The apparatus, in accordance with the invention, comprises a pipe adapted to be inserted into the taphole and means for blowing air into the pipe initially at a predetermined pressure so as to reverse the flow of the molten metal in the taphole and then at a reduced pressure sufficient to hold the metal in the furnace.

The outside diameter of the pipe must be of sufficient dimension to seal the taphole. It is usually slightly larger than the taphole and the latter is funnel-shaped on the outside to provide a good seal.

The pipe used for blowing air into the taphole may be made in two portions, a first one which is rotatably mounted on the furnace and a second one which is pivotally mounted about the axis of the first pipe portion inwardly towards the furnace and into the taphole.

The above-mentioned first portion of the pipe may be mounted on the furnace by means of a platform which is secured to the wall of the furnace, a second horizontally adjustable platform mounted on the first platform and a third vertically adjustable platform mounted on the second platform so as to precisely adjust the position of the second pipe portion with respect to the taphole.

The first pipe portion may include a horizontal shaft rotatably mounted on the above-mentioned vertically adjustable platform and a connecting rod may be secured to such horizontal shaft and operated by a cylinder having its piston attached to such connecting rod. Rotation of the shaft and, consequently, of the second pipe portion into and out of the taphole will thus be under the control of the cylinder.

The apparatus may also be provided with means for locking the second pipe portion into the taphole. Such means could include a safety lock bracket having one end secured to the furnace and a fork portion at its other end adapted to receive the second pipe portion. A pin may be provided for locking the second pipe portion to the safety lock bracket.

The furnace may also be provided with two tapholes which are alternatively used and, in such a case, the above-mentioned second pipe portion may be removably attached to one end of the above-mentioned shaft and adapted to be secured to the other end of such shaft so as to plug the other taphole.

BRIEF DESCRIPTION OF THE DRAWINGS

The invention will now be disclosed, by way of example, with reference to the description of preferred embodiments thereof illustrated in the accompanying drawings in which.

DETAILED DESCRIPTION

Figure 1:
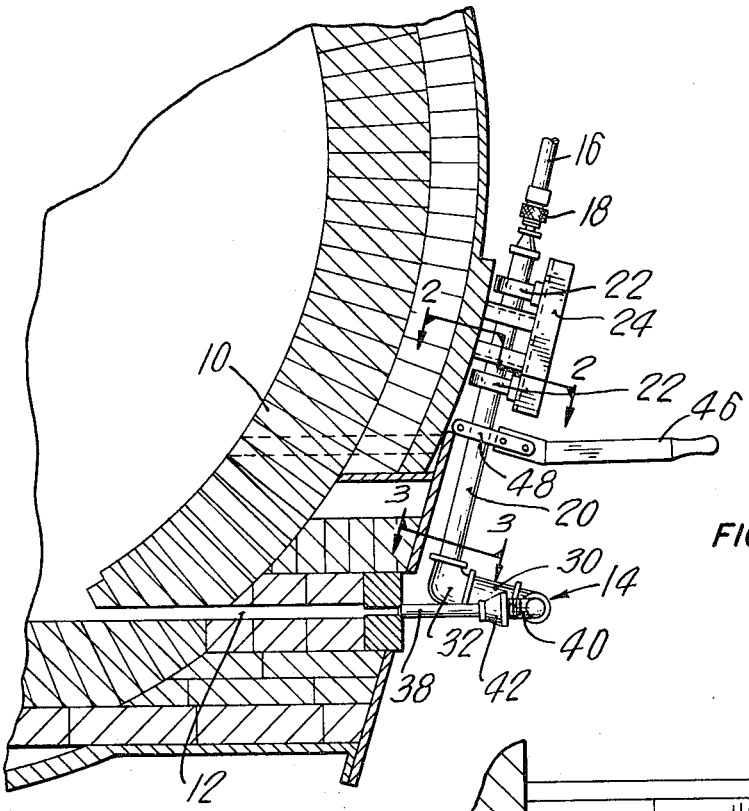
FIG. 1 illustrates a first embodiment of an apparatus for stopping the flow of metal from the taphole of a furnace.

Referring to FIG. 1, there is shown a fragmentary vertical cross-section of a cylindrical furnace 10 having a taphole 12 adapted to be plugged by a metal pipe designated generally by reference numeral 14 and adapted to be inserted into the taphole. The pipe 14 may be connected to an air line 16 through a suitable connector 18 for blowing air into the taphole initially at a predetermined pressure so as to reverse the flow of the molten metal in the taphole and then at a reduced pressure sufficient to hold the metal in the furnace.

Figure 2:
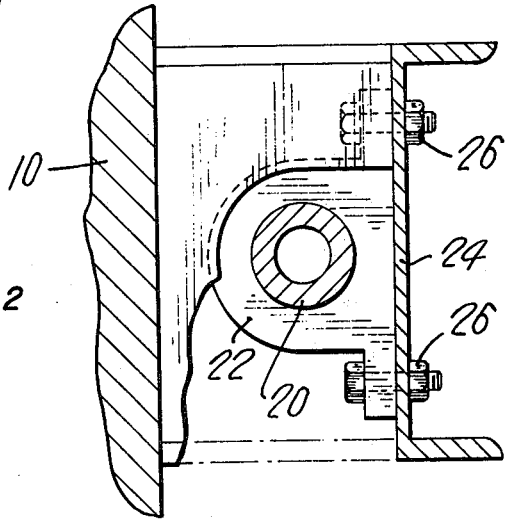
FIG. 2 illustrates a section view of the apparatus taken along lines 2—2 of FIG. 1.

The pipe 14 includes a first vertical portion 20 which is rotatably mounted onto pillow blocks 22 secured to a support 24 welded or otherwise secured to the wall of the furnace 10. The pillow blocks 22 may be secured to support 24 by means of bolts 26 as illustrated more clearly in FIG. 2 of the drawings.

Figure 3:
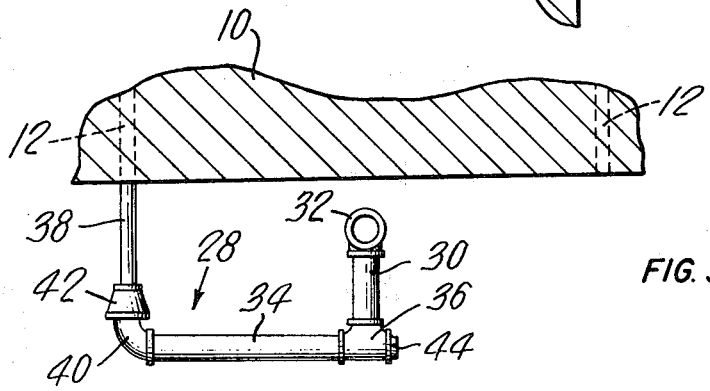
FIG. 3 illustrates a section view of the apparatus taken along lines 3—3 of FIG. 1.
Figure 4:
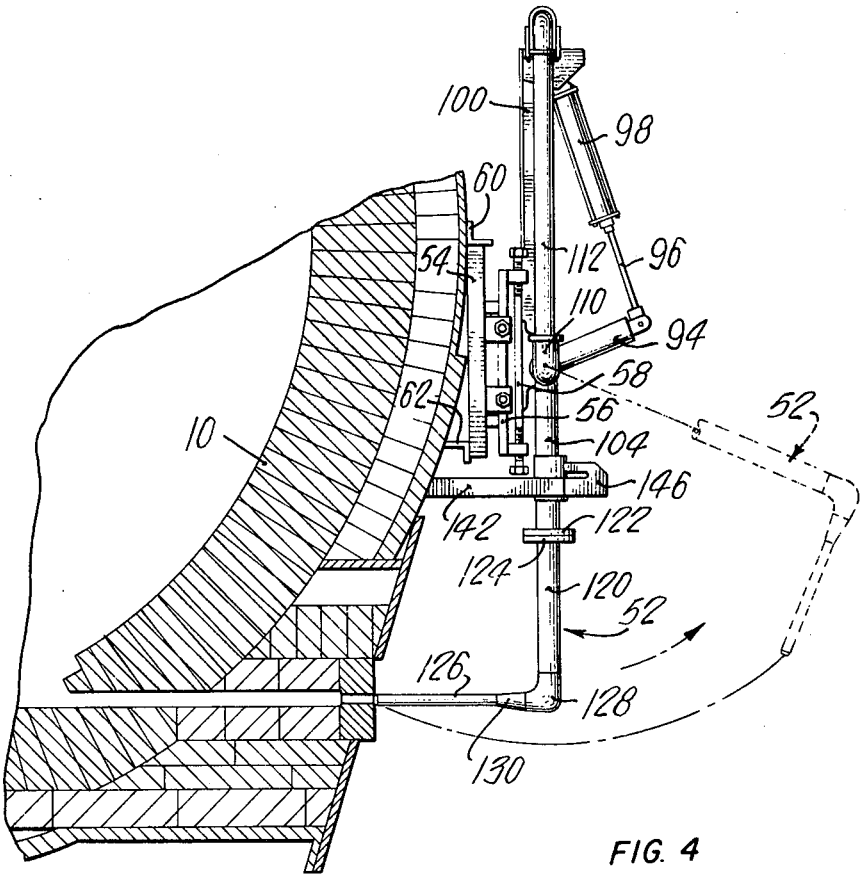
FIGS. 4 and 5 illustrate respectively a side and plan view of a second apparatus in accordance with the invention.

The pipe 14 includes a second portion illustrated generally by reference numeral 28 in FIG. 3 of the drawings and which is mounted for clockwise movement around vertical pipe portion 20 towards the furnace into the taphole 12. Such second pipe portion 28 comprises a first pipe section 30 secured to the first pipe portion 20 by means of elbow 32, a second pipe section 34 secured to pipe section 30 by means of tee 36, and a third pipe section 38 of reduced diameter secured to pipe section 34 through elbow 40 and reducer 42. The outside diameter of pipe section 38 is slightly larger than the inside diameter of taphole 12 and the taphole is funnel-shaped on the outside to provide a good seal. It is to be understood that the pipe sections 34 and 38 may be mounted on either side of the tee 36 so as to permit to plug either one of two tapholes located one on the left-hand side and the other on the right-hand side of the first pipe portion 20. In either case, the unused opening of the tee 36 is closed by a plug 44.

The pipe portion 20 may be rotated manually by means of a handle 46 secured to it by clamp 48.

The pipe portion 20 is connected to the high pressure line 16 by means of a swing joint (not shown) so as to permit pivotal movement thereof.

A second embodiment of the apparatus in accordance with the invention is illustrated in FIGS. 4 to 10 of the drawings and includes a metal pipe having a first horizontal portion indicated generally by reference numeral 50 and a second portion indicated generally by reference numeral 52 and adapted for pivotal movement about horizontal portion 50 downwardly and inwardly towards the furnace and into the taphole.

Figure 5:
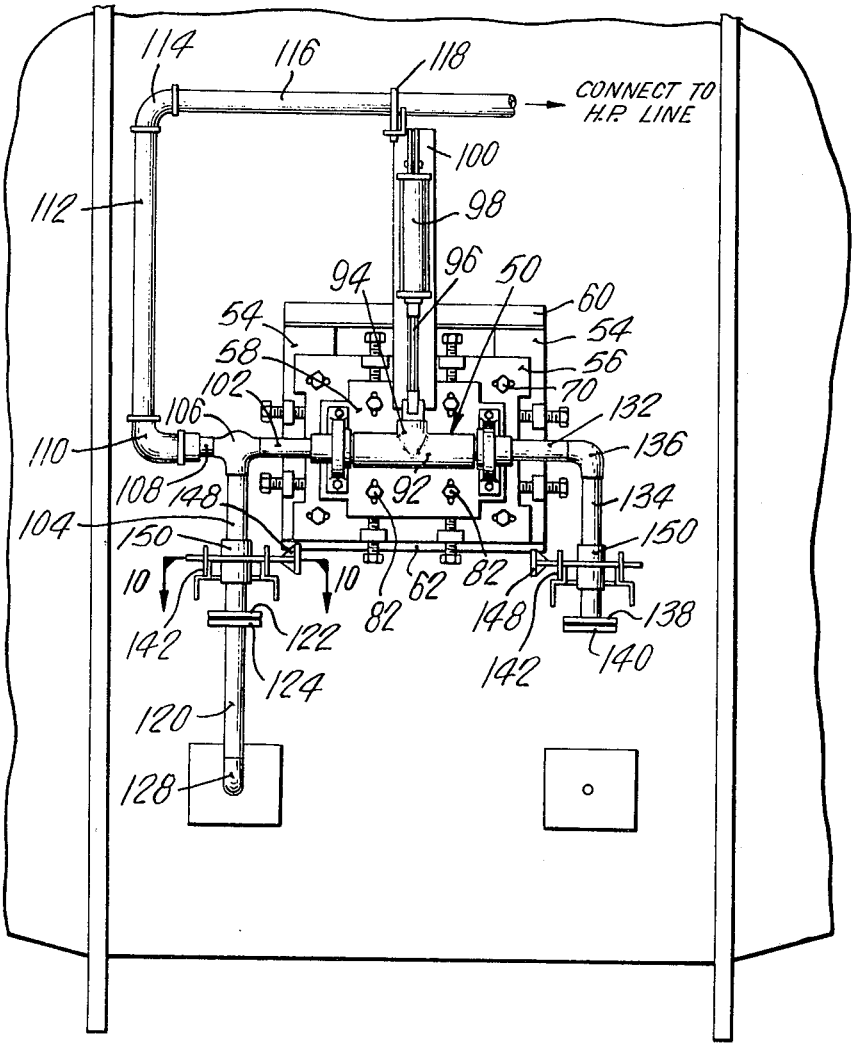
Figure 6:
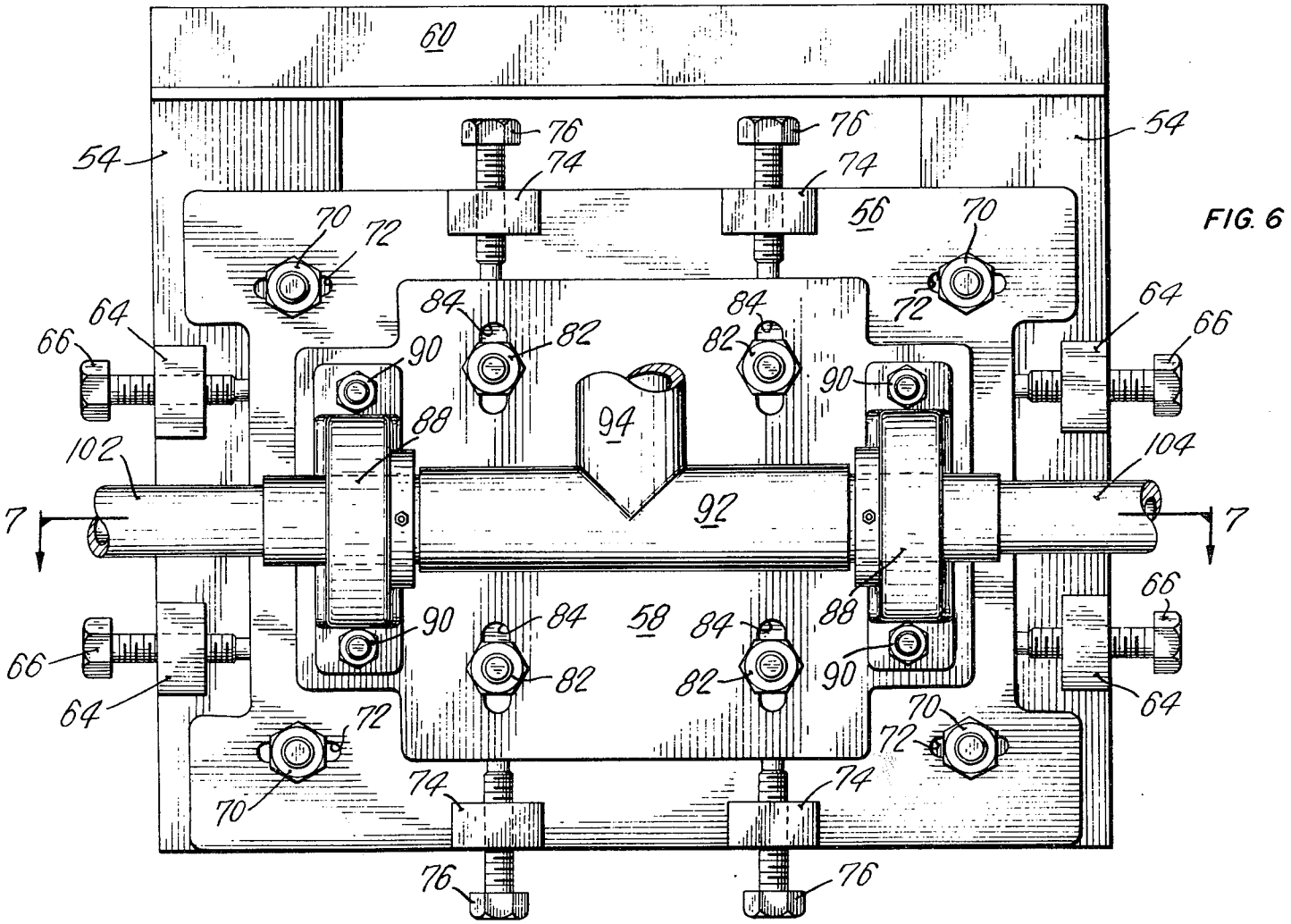
FIG. 6 illustrates an enlarged view of the platforms used for mounting the apparatus of FIGS. 4 and 5 onto the furnace.
Figure 7:
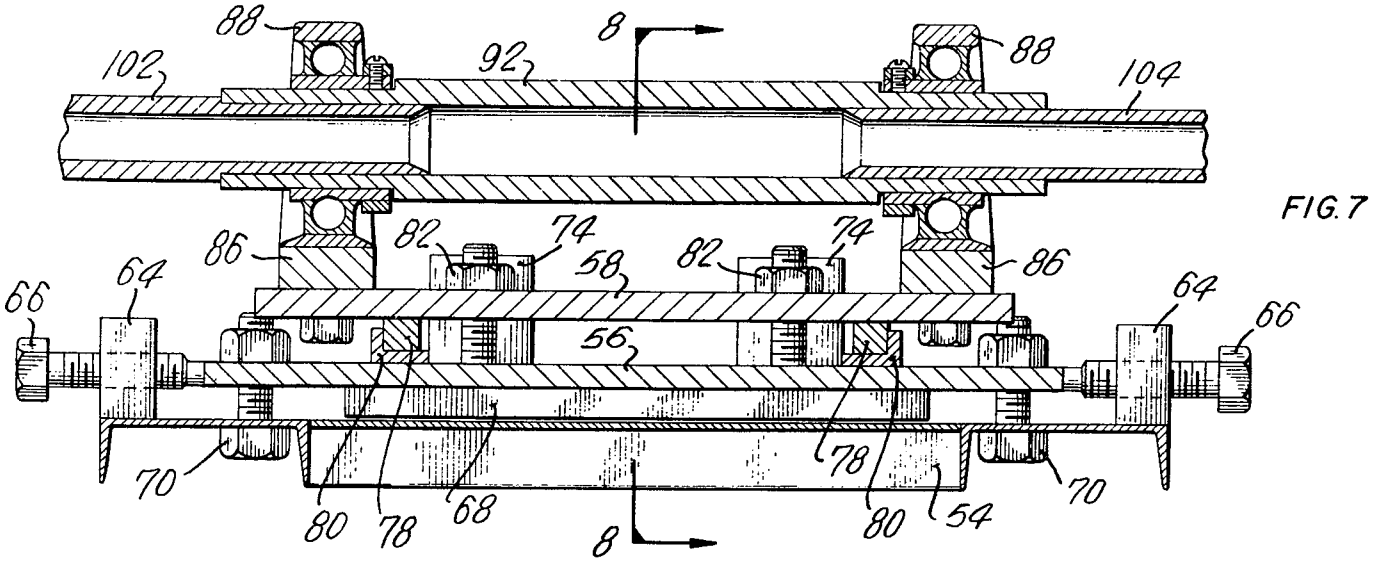
FIG. 7 illustrates a section view taken along lines 7—7 of FIG. 6.
Figure 8:
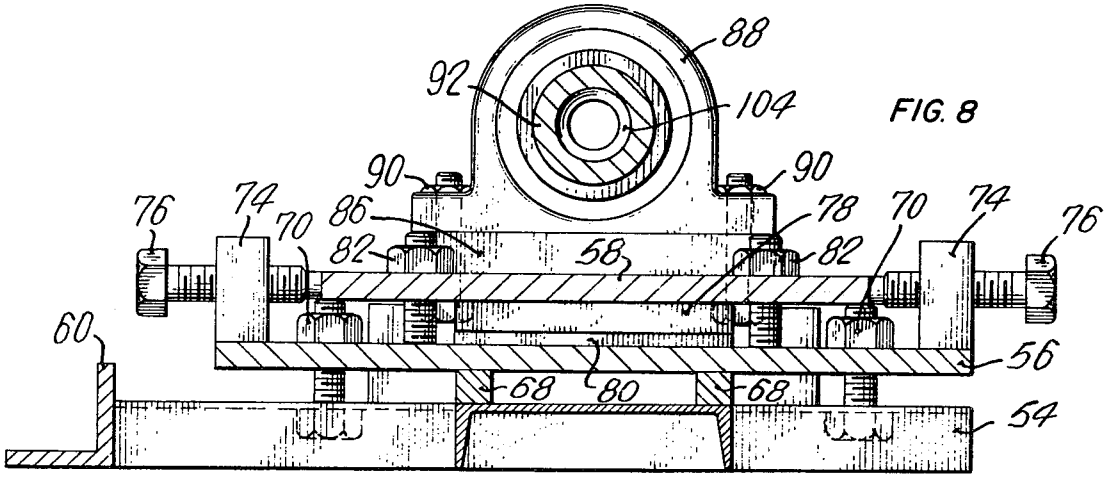
FIG. 8 illustrates a section view taken along lines 8—8 of FIG. 7.

Referring more particularly to FIGS. 5–7, the horizontal pipe portion 50 is mounted to the furnace by means of a first platform 54 which is secured to the wall of the furnace, a second platform 56 which is movable horizontally on the first platform 54, and a third platform 58 which is movable vertically with respect to the second platform 56 so as to permit to precisely adjust the position of the second pipe portion 52 with respect to the taphole.

The first platform 54 is welded or otherwise secured to brackets 60 and 62 which are in turn secured to the furnace. Platform 54 is H-shaped as illustrated in FIGS. 5–7 although it could obviously be of rectangular shape. Blocks 64 through which extend set screws 66 are mounted on both vertical arms of the platform 54. Set screws 66 are provided for adjusting the horizontal position of platform 56 with respect to fixed platform 54.

The second platform 56 is provided with slides 68 for permitting the platform to move easily on the transverse portion of the H-shaped platform 54. Platform 56 is secured to fixed platform 54 by means of bolts 70. Slots 72 are provided into platform 56 to permit horizontal movement of the platform during adjustment of the set screws 66. Blocks 74 through which extend set screws 76 are also provided on the second platform 56 for adjusting the position of the third platform 58 with respect to the the second platform 56.

The third platform 58 is provided with slides 78 which move on guides 80 secured to platform 56 for permitting vertical adjustment of platform 58 with respect to platform 56. Platform 58 is fixed in position with respect to platform 56 by means of bolts 82 sliding in slots 84. The platform 58 is also provided with blocks 86 for supporting pillow blocks 88 which are secured to the platform by means of bolts 90. A hollow shaft 92 forming part of the first pipe portion 50 is rotatably mounted in pillow blocks 88.

Figure 9:
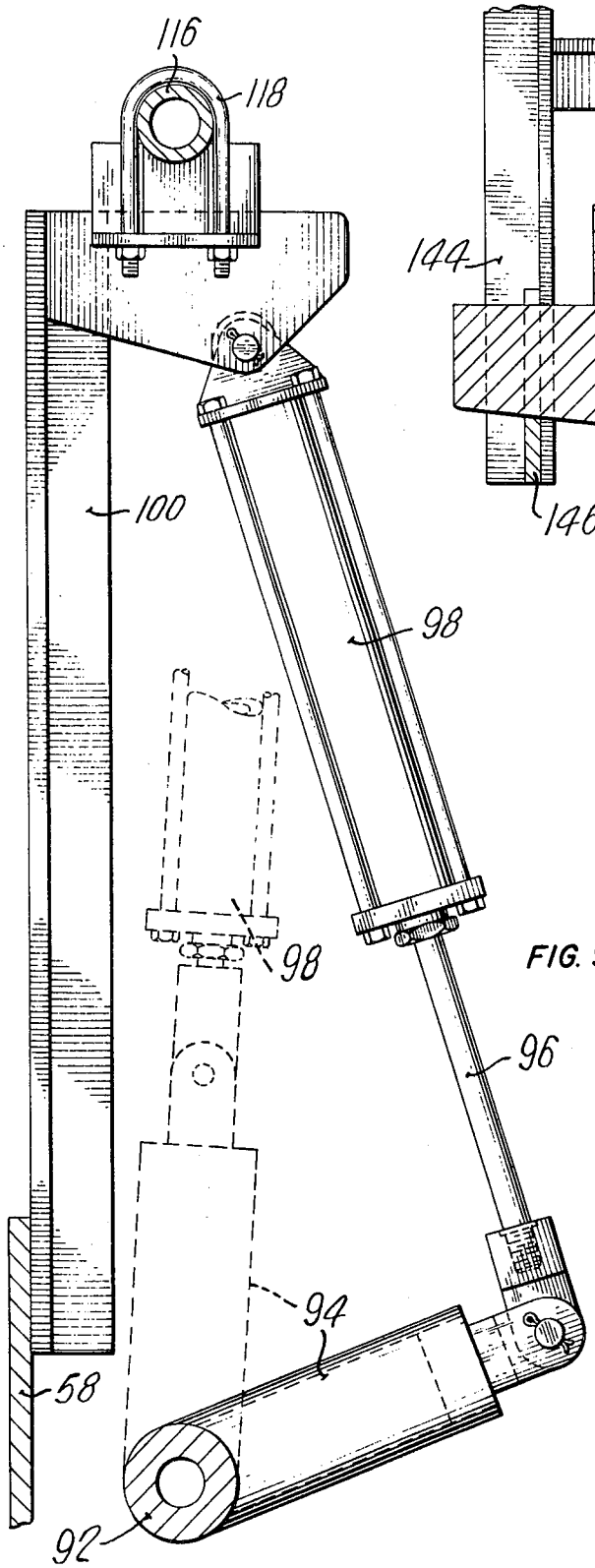
FIG. 9 illustrates an enlarged view of the arrangement of FIGS. 4 and 5 for moving the pipe into and out of the taphole.
Figure 10:
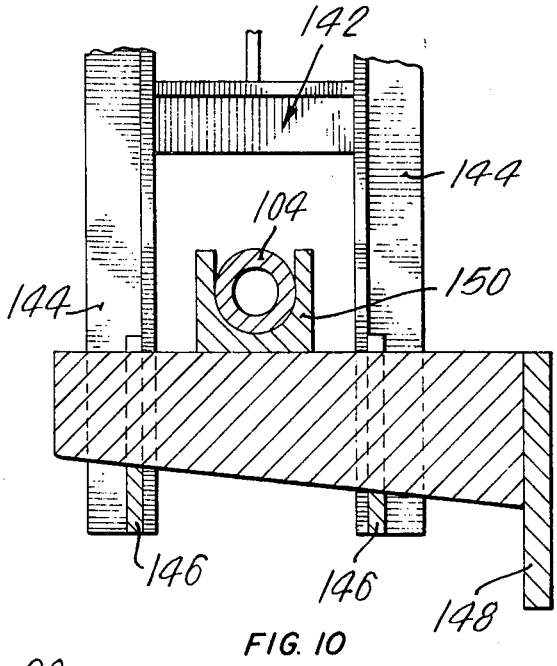
FIG. 10 illustrates an enlarged view of the device for locking the pipe into the taphole.

As illustrated more clearly in FIG. 9, a connecting rod 94 is secured to shaft 92 and the piston 96 of a cylinder 98 is secured to such connecting rod for rotating the shaft 92 by a predetermined angle. The cylinder is supported by a vertical bracket 100 secured to vertically movable platform 58. The cylinder may be operated by a high pressure air line or by an hydraulic fluid. It is to be understood that the angular movement of shaft 92 must be sufficient to move the second pipe portion 52 out of the path of the molten metal flowing out of the taphole 12.

Referring back to FIG. 5, the first pipe portion 50 is formed, in addition to hollow shaft 92, of at least one pipe section 102 which is fixed coaxially to the end of shaft 92. The second pipe portion 52 includes a first pipe section 104 secured to pipe section 102 by means of tee 106. The free end of tee 106 is fed with air coming from a high pressure line through pipe section 108, swing joint 110, pipe section 112, elbow 114, and pipe section 116. Pipe section 116 is supported by clamp 118 secured to vertical bracket 100. The second pipe portion also includes pipe section 120 which is secured to pipe section 104 by means of flanges 122 and 124, and a pipe section 126 which is secured to pipe section 120 by means of elbow 128 and reducer 130. The outside diameter of pipe section 126 is slightly larger than the inside diameter of the taphole and the taphole is funnel-shaped on the outside to provide a good seal.

The furnace 10 may be provided with two tapholes which are alternatively used and, in such a case, the apparatus in accordance with the invention, is provided with a second pipe section 132 which is secured to the other end of shaft 92. A pipe section 134 is secured to pipe section 132 by means of elbow 136. Such pipe section is terminated by a flange 138 identical to flange 122 and is blocked by blank flange 140. It will be easily understood that pipe section 120 may thus be attached to either end of pipe sections 104 or 134.

The pivotable pipe section 52 must be locked in position when it is introduced into the taphole. Consequently, a safety lock bracket 142 is welded or otherwise secured to the furnace. As illustrated perhaps more clearly in FIG. 10, the end of bracket 142 is made of two L-shaped channels 144 between which the pipe section 104 or 134 is inserted. A bracket 146 is welded or otherwise secured to each channel 144 and such bracket has a slot therein adapted to receive a wedge 148 which may be hammered in to securely lock pipe section 126 into the taphole. In order to protect sections 104 or 134, a reinforcing bracket 150 is secured thereto.

The above arrangement has been used successfully to plug a copper smelting furnace having a level of 53 inches of molten copper, matte and slag. It was found that, with such a thickness of material, a pressure of 60–70 psi was needed to stop the flow of molten metal. Once the flow was reversed, an air pressure of 20–30 psi was sufficient to hold the metal into the furnace. It is to be understood that the above method and apparatus could be used for plugging furnaces used for smelting other metals. Of course, the pressures required to stop and to hold the metal will vary with the density of the metal and also with the height of material in the furnace.

As mentioned previously, the metal can be made to freeze in the hole by lowering the air pressure slowly so that the metal may penetrate into the taphole and cool therein for plugging the taphole. On the other hand, when the metal is maintained into the furnace by the above-mentioned reduced pressure, it can be made to flow again by removing the pipe quickly from the taphole.

The reversal of the flow of metal in the taphole is detected when pulses on the air line indicate that air is being blown through the melt in the furnace. The pressure is then reduced to maintain steady pulses. Such pressure is normally reduced by manual control.

Two embodiments have been disclosed for carrying out the method of the invention. However, it is to be understood that such embodiments have been disclosed by way of example only and that various alternatives are also envisaged within the scope of the claims accompanying the present description of the invention. For example, various ways of moving a pipe into and out of the taphole may be envisaged. The portion of the pipe being inserted into the taphole does not have to be pivoted around a shaft. It could be linearly moved into and out of the taphole and then sideways out of the path of the molten metal. The taphole does not necessarily have to be funnel-shaped on the outside to receive a pipe which is slightly larger than the inside diameter of the taphole. The outside diameter of the pipe could be made to correspond exactly to the inside diameter of the taphole so as to provide a good seal.

We claim:

1. An apparatus for stopping the flow of metal from the taphole of a furnace, the apparatus comprising:

a. a hollow pipe adapted to be inserted into said taphole, said pipe having a first portion which is rotatably mounted on said furnace and a second portion which is mounted for rotation about the axis of said first portion inwardly towards the furnace and into the taphole, said second portion having an outside diameter of sufficient dimension to seal the taphole;

b. means for mounting the first portion of said pipe to said furnace including a first platform which is secured to the wall of the furnace, a second horizontally adjustable platform mounted on said first platform and a third vertically adjustable platform mounted on said second platform, so as to precisely adjust the position of said second pipe portion with respect to the taphole;

c. means for blowing air into said taphole through said pipe; and d. means for controlling the pressure of the air being blown into said taphole in accordance with a pressure schedule in which the air is blown initially at a first pressure so as to just reverse the flow of the molten metal into the taphole without substantial air being blown into the furnace, and then at a second and reduced pressure just sufficient to hold the metal in the furnace without flow of metal through the taphole.

2. An apparatus as defined in claim 1, further comprising means for pivoting said first pipe portion so as to move said second pipe portion into and out of said taphole.

3. An apparatus as defined in claim 2, wherein said means for pivoting said first pipe portion is a handle secured to the first pipe portion.

4. An apparatus as defined in claim 2, wherein the first pipe portion includes a horizontal shaft rotatably mounted on said vertically adjustable platform, and wherein said means for pivoting said first pipe portion includes a connecting rod perpendicularly secured to said pipe, a vertical bracket secured to said vertically adjustable platform, and a cylinder attached to said bracket and having its piston connected to said connecting rod to rotate said connecting rod by a predetermined angle.

5. An apparatus as defined in claim 4, further comprising means for locking said second pipe portion into the taphole including a safety lock bracket having one end secured to the furnace and a fork portion at its other end adapted to receive the second pipe portion, and a pin for locking said second pipe portion to said safety lock bracket.

6. An apparatus as defined in claim 5, wherein said pin is wedge shaped and is forced between said second pipe portion and said safety lock bracket so as to push the end of said second pipe portion into the taphole.

7. An apparatus as defined in claim 4, wherein said first pipe portion also includes a pipe section coaxially secured to at least one end of said shaft and wherein said second pipe portion includes a first pipe section secured perpendicularly to the pipe section of said first pipe portion, a second pipe section secured coaxially with said first pipe section and a third pipe section secured perpendicularly to said second pipe section, said second pipe portion being adapted for pivotal movement about said first pipe portion downwardly and inwardly towards the furnace into the taphole.

8. An apparatus as defined in claim 7, wherein said furnace has two tapholes at a predetermined horizontal distance, wherein said first pipe portion includes an additional pipe section secured to the other end of said shaft, and wherein said second pipe portion includes a fourth pipe section perpendicularly secured to said additional pipe section, said second and third pipe sections being removably secured to said first pipe section and being adapted to be secured to said fourth pipe section when it is desired to operate the second taphole.

* * * * *